US009520246B2

(12) United States Patent
Naka et al.

(10) Patent No.: US 9,520,246 B2
(45) Date of Patent: Dec. 13, 2016

(54) ELECTROMAGNETIC CONTACTOR

(71) Applicant: FUJI ELECTRIC FA COMPONENTS & SYSTEMS CO., LTD., Chuo-ku, Tokyo (JP)

(72) Inventors: Yasuhiro Naka, Kounosu (JP); Kouetsu Takaya, Kounosu (JP); Kenji Suzuki, Kounosu (JP); Yuji Shiba, Kounosu (JP); Takanori Takemoto, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/676,896

(22) Filed: Apr. 2, 2015

(65) Prior Publication Data

US 2015/0206684 A1 Jul. 23, 2015

Related U.S. Application Data

(63) Continuation of application No. PCT/JP2013/006018, filed on Oct. 9, 2013.

(30) Foreign Application Priority Data

Dec. 5, 2012 (JP) ..... 2012-266238

(51) Int. Cl.
*H01H 1/50* (2006.01)
*H01H 50/54* (2006.01)
(Continued)

(52) U.S. Cl.
CPC ..... *H01H 1/50* (2013.01); *H01H 50/546* (2013.01); *H01H 50/60* (2013.01); *H01H 51/065* (2013.01);
(Continued)

(58) Field of Classification Search
CPC ..... H01H 1/50; H01H 50/60; H01H 51/065; H01H 50/546; H01H 50/42; H01H 2050/025
See application file for complete search history.

(56) References Cited

U.S. PATENT DOCUMENTS 3,602,850 A * 8/1971 Grunert ..... H01H 50/546 335/133
3,781,728 A * 12/1973 Grunert ..... H01H 9/345 200/50.1
(Continued)

FOREIGN PATENT DOCUMENTS

CN 201927550 U 8/2011
DE 3834155 A1 4/1990
(Continued)

OTHER PUBLICATIONS

PCT, "International Search Report for International Application No. PCT/JP2013/006018".
(Continued)

*Primary Examiner* — Mohamad Musleh
(74) *Attorney, Agent, or Firm* — Manabu Kanesaka

(57) ABSTRACT

An electromagnetic contactor includes a contact mechanism having a pair of fixed contacts disposed to maintain a predetermined interval in a longitudinal direction, and a movable contact disposed above the pair of fixed contacts, the movable contact contacting to and detaching from the pair of fixed contacts. Each of the pair of fixed contacts has a fixed contact portion, the movable contact extends in a longitudinal direction thereof and has a pair of movable contact portions contacting the pair of fixed contacts, and the movable contact is disposed so as to move in a vertical direction thereof on a connecting shaft fixed to a movable plunger and is pressed down by a biasing force of a contact spring in a downward direction thereof on a central portion
(Continued)

of the movable contact in the longitudinal direction, the movable contact being held on the connecting shaft.

4 Claims, 6 Drawing Sheets

(51) Int. Cl.
*H01H 51/06* (2006.01)
*H01H 50/60* (2006.01)
*H01H 50/42* (2006.01)
*H01H 50/02* (2006.01)

(52) U.S. Cl.
CPC ..... *H01H 50/42* (2013.01); *H01H 2050/025* (2013.01)

(56) References Cited

U.S. PATENT DOCUMENTS 3,870,980 A * 3/1975 Pollmann ..... H01H 50/645 335/202
3,964,006 A * 6/1976 Lacan ..... H01H 50/546 335/132
4,489,296 A * 12/1984 Guery ..... H01H 1/20 200/243
8,994,482 B2 3/2015 Yokoyama et al.
9,202,652 B2 12/2015 Naka et al.
2005/0072591 A1* 4/2005 Hayase ..... H01H 50/14 174/667
2005/0219019 A1* 10/2005 Braun ..... H01H 1/20 335/126
2013/0113580 A1 5/2013 Naka et al.

FOREIGN PATENT DOCUMENTS

JP S56-44453 U 4/1981
JP S61-18602 Y2 6/1986
JP 2010-010057 A 1/2010
JP 2011-210576 A 10/2011
JP 2012-028252 A 2/2012
RU 2155407 C2 8/2000
WO 2012/157170 A1 11/2012
WO 2012/157216 A1 11/2012

OTHER PUBLICATIONS

China Patent Office, "Office Action for Chinese Patent Application No. 201380052772.3," Mar. 30, 2016.

* cited by examiner

ELECTROMAGNETIC CONTACTOR

RELATED APPLICATIONS

The present application is a Continuation Application of International Application No. PCT/JP2013/006018 filed Oct. 9, 2013, which claims a priority from Japanese Application No. 2012-266238 filed Dec. 5, 2012.

TECHNICAL FIELD

The present invention relates to an electromagnetic contactor including a contact mechanism having a pair of fixed contacts disposed to maintain a predetermined interval in a longitudinal direction and a movable contact that is connectable to and detachable from the fixed contacts.

BACKGROUND ART

Heretofore, for example, an electromagnetic contactor shown in FIG. 5, FIG. 6(*a*) and FIG. 6(*b*) is known as an electromagnetic contactor having a contact mechanism that includes a pair of fixed contacts disposed to maintain a predetermined interval and a movable contact that is connectable to and detachable from the pair of fixed contacts (refer to PTL 1).

An electromagnetic contactor 101 shown in FIG. 5 includes a main body case 102 having a two-part structure of an upper case 102*a* and lower case 102*b*. A contact mechanism CM is installed inside the upper case 102*a*. The contact mechanism CM includes a pair of fixed contacts 103, disposed to maintain a predetermined interval in a longitudinal direction (the left-right direction in FIG. 5) in the upper case 102*a*, and a movable contact 104 disposed so as to be connectable to and detachable from the fixed contacts 103. Fixed contacts 103*a* and 103*b* are respectively provided on the pair of fixed contacts 103. Also, the movable contact 104 extends in a longitudinal direction (the left-right direction in FIG. 5, the direction in which the pair of fixed contacts 103 are disposed), and movable contacts 104*a* and 104*b* that contacts with the fixed contacts 103*a* and 103*b* are provided at two ends of the movable contact 104 in the longitudinal direction.

Meanwhile, an operating electromagnet 105 that drives the movable contact 104 is disposed in the lower case 102*b*. The operating electromagnet 105 includes a fixed iron core 106 and a movable iron core 107 disposed above and opposing the fixed iron core 106. Further, an electromagnetic coil 109 disposed and wound in a coil holder 108 is fixed in a central bottom portion of the fixed iron core 106, and a return spring 110 that biases the movable iron core 107 in a direction away from the fixed iron core 106 (an upward direction) is disposed between the upper surface of the coil holder 108 and the movable iron core 107.

Also, a contact holder 111 is connected to the upper end of the movable iron core 107. An insertion hole 111*a* is formed in the upper end side of the contact holder 111, and the movable contact 104 is disposed in the insertion hole 111*a* so as to be able to move in a vertical direction. The movable contact 104 is formed of a plate-form member that is long and thin in a longitudinal direction, and a portion substantially central in the longitudinal direction is urged downward and held by a predetermined urging force of a contact spring 112 installed inside the insertion hole 111*a*. Further, when the movable contact 104 contacts the fixed contacts 103, the contact spring 112 applies a predetermined contact pressure to the fixed contacts 103.

In the electromagnetic contactor 101 formed in this way, when the electromagnetic coil 109 of the operating electromagnet 105 is in a non-excited state, and is in a released state; no electromagnetic suctioning force is generated between the fixed iron core 106 and movable iron core 107, and the movable iron core 107 is biased upward in a direction away from the fixed iron core 106 by the return spring 110. Further, the contact holder 111 connected to the movable iron core 107 is held in a current interrupting position (final state of release) by coming into contact with a stopper 113. In the current interrupting position, as shown in FIG. 6(*a*), the movable contacts 104*a* and 104*b* provided on the movable contact 104 are separated upward from the fixed contacts 103*a* and 103*b* respectively provided on the pair of fixed contacts 103, whereby the contact mechanism CM is in an opened state.

On the electromagnetic coil 109 of the operating electromagnet 105 excited when the contact mechanism CM is in an open state, to create an engaged state, a suctioning force is generated between the fixed iron core 106 and movable iron core 107, and the movable iron core 107 is suctioned downward against the return spring 110. Because of this, the movable contact 104 held by the contact holder 111 descends, and the contact mechanism CM changes to a closed state. In the closed state, as shown in FIG. 6(*b*), the movable contacts 104*a* and 104*b* provided on the movable contact 104 contacts the fixed contacts 103*a* and 103*b* respectively provided on the pair of fixed contacts 103 with the contact pressure of the contact spring 112, and current input from an external input terminal 103*c* is supplied to an external connection terminal 103*d* through the fixed contact 103, movable contact 104, and fixed contact 103.

Further, when the electromagnetic coil 109 of the operating electromagnet 105 changes to a non-excited state, the movable contact 104 carries out an operation reverse to the heretofore described operation, the contact mechanism CM changes to an open state, and the contact holder 111 connected to the movable iron core 107 is held in a current interrupting position (final state of release) by coming into contact with the stopper 113.

CITATION LIST

Patent Literature

PTL 1: JP-A-2012-28252

SUMMARY OF INVENTION

Technical Problem

However, the existing electromagnetic contactor 101 described in PTL 1 shown in FIG. 5, FIG. 6(*a*) and FIG. 6 (*b*) has the following problems.

That is, when the contact mechanism CM is in a closed state, the movable contact 104 is pressed down and held by a predetermined biasing force of the contact spring 112 in the downward direction. Because of this, when the movable contact 104 comes into contact with the fixed contacts 103, the contact force of the movable contact 104 with respect to the fixed contacts 103 is applied with only the biasing force of the contact spring 112, which is formed of a compression spring. That is, the movable contact 104 comes into contact with the fixed contacts 103 with the single biasing force of the contact spring 112 positioned in the longitudinal direction center of the movable contact 104. Because of this, it may happen that the flatness of the contact spring 112 is inappropriate, or that the movable contact 104 wobbles in the longitudinal direction depending on the direction in which the contact spring 112 is attached. In the case that the movable contact 104 wobbles in the longitudinal direction when the contact mechanism CM is in a closed state, there are problems that the movable contact 104 emits a whirring sound, the bounce of the movable contact 104 increases, and erosion of the movable contact 104 and fixed contacts 103 by the arc becomes severe.

Also, when the contact mechanism CM is in an open state too, it may happen that the movable contact 104 wobbles in the longitudinal direction when the movable contact 104 is in the final state of release, thereby, the contact gap does not become uniform in the longitudinal direction of the movable contact 104, and stable interruption is not possible.

Consequently, the invention, having been contrived to solve these problems, has an object of providing an electromagnetic contactor to prevent wobble in the longitudinal direction of the movable contact when the contact mechanism is in a closed state and open state.

Solution to Problem

In order to achieve the heretofore described object, an electromagnetic contactor according to an aspect of the invention includes a contact mechanism having a pair of fixed contacts disposed to maintain a predetermined interval in a longitudinal direction and a movable contact, disposed above the pair of fixed contacts, that is connectable to and detachable from the pair of fixed contacts, wherein each of the pair of fixed contacts has a fixed contact portion, the movable contact extends in a longitudinal direction thereof and has a pair of movable contact portions that contact the pair of fixed contact portions, and the movable contact is disposed so as to be able to move in a vertical direction thereof on a connecting shaft fixed to a movable plunger and is pressed down by a downward direction urging force of a contact spring on a central portion of the movable contact in the longitudinal direction, thereby being held on the connecting shaft. A plate spring member extends in the longitudinal direction and has, in vicinities of two outer ends in a longitudinal direction thereof, a pair of urging force application portions that applies a predetermined urging force in a downward direction to the pair of movable contact portions; and the plate spring member is attached to the connecting shaft.

Also, the electromagnetic contactor is formed such that the plate spring member includes an attachment plate portion disposed between a lower end of the contact spring and an upper surface of the movable contact and gripped between the lower end of the contact spring and the upper surface of the movable contact by the urging force of the contact spring, a pair of inclined portions extending diagonally upward and outward from two outer ends of the attachment plate portion in a longitudinal direction thereof, a pair of horizontal portions extending outward horizontally in the longitudinal direction from an end portion of each of the pair of inclined portions, and a pair of urging force application portions, standing downward from the outer end portion of each of the pair of horizontal portions in the longitudinal direction, that applies a predetermined urging force in a downward direction to the pair of movable contact portions.

Furthermore, the electromagnetic contactor is formed such that the plate spring member includes an attachment plate portion disposed between the upper end of the contact spring and a C-ring attached to the connecting shaft and gripped between the upper end of the contact spring and the C-ring by the urging force of the contact spring, a pair of inclined arm portions extending diagonally downward and outward from two outer ends of the attachment plate portion in the longitudinal direction, and a pair of urging force application portions, provided on an end portion of each of the pair of inclined arm portions, that applies a predetermined urging force in a downward direction to the pair of movable contact portions.

Advantageous Effects of Invention

The electromagnetic contactor according to the invention includes a contact mechanism having a pair of fixed contacts disposed to maintain a predetermined interval in a longitudinal direction and a movable contact, disposed above the pair of fixed contacts, that is connectable to and detachable from the pair of fixed contacts, wherein each of the pair of fixed contacts has a fixed contact portion, the movable contact extends in a longitudinal direction thereof and has a pair of movable contact portions that contacts the pair of fixed contact portions, and the movable contact is disposed so as to be able to move in a vertical direction thereof on a connecting shaft fixed to a movable plunger and is pressed down by a urging force of a contact spring in a downward direction on a central portion of the movable contact in the longitudinal direction, thereby being held on the connecting shaft. A plate spring member extends in the longitudinal direction and has, in vicinities of two outer ends in a longitudinal direction thereof, a pair of urging force application portions that applies a predetermined urging force in a downward direction to the pair of movable contact portions, and the plate spring member is attached to the connecting shaft. Because of this, the movable contact is pressed down by the urging force of the contact spring in the downward direction on the central portion in the longitudinal direction, and by the urging force in the downward direction on the pair of movable contact portions of the pair of urging force application portions in the vicinities of two outer ends of the plate spring member in the longitudinal direction, and thus held on the connecting shaft. Because of this, when the contact mechanism is in a closed state, the pair of movable contact portions is brought into contact with the pair of fixed contacts by three urging forces, which are the urging force of the contact spring on the central portion of the movable contact in the longitudinal direction, and the urging force of the pair of urging force application portions in the vicinities of two outer ends of the plate spring member in the longitudinal direction. Because of this, the movable contact does not wobble in the longitudinal direction, even when the flatness of the contact spring is inappropriate, or there is a deviation in the direction that the contact spring is attached. Because of this, when the contact mechanism is in a closed state, emission of a whirring sound and erosion of the movable contact and pair of fixed contacts by the arc can be suppressed.

Also, when the contact mechanism is in an open state, the movable contact is pressed down by the urging force of the contact spring in the downward direction on the central portion in the longitudinal direction, and by the urging force in the downward direction on the pair of movable contact portions of the pair of urging force application portions in the vicinities of two outer ends of the plate spring member in the longitudinal direction, and thus held on the connecting shaft. Because of this, when the movable contact is in the final state of release, the movable contact does not wobble in the longitudinal direction. Because of this, the contact gap is uniform in the longitudinal direction of the movable contact, and stable interruption is achieved.

Also, the electromagnetic contactor is formed such that when the plate spring member includes an attachment plate portion disposed between the lower end of the contact spring and the upper surface of the movable contact and gripped between the lower end of the contact spring and the upper surface of the movable contact by the urging force of the contact spring, the plate spring member can be attached to the connecting shaft by the attachment plate portion of the plate spring member disposed between the lower end of the contact spring and the upper surface of the movable contact. Further, as a pair of urging force application portions stands downward from the outer end portion of each of a pair of horizontal portions in the longitudinal direction through a pair of inclined portions extending diagonally upward and outward from two outer ends of the attachment plate portion in the longitudinal direction and the pair of horizontal portions extending outward horizontally in a longitudinal direction from an end portion of each of the pair of inclined portions, and applies a predetermined urging force in a downward direction to the pair of movable contact portions; the pair of urging force application portions has sufficient springiness, and it is thus possible to reliably and stably apply the predetermined urging force in a downward direction to the pair of movable contact portions.

Furthermore, the electromagnetic contactor is formed such that when the plate spring member includes an attachment plate portion disposed between the upper end of the contact spring and a C-ring attached to the connecting shaft and gripped between the upper end of the contact spring and the C-ring by the urging force of the contact spring, the plate spring member can be attached to the connecting shaft by the attachment plate portion of the plate spring member disposed between the upper end of the contact spring and the C-ring. In this case, the attachment plate portion of the plate spring member also functions as a contact spring upper end support member that supports the upper end of the contact spring, and there is thus no need to separately provide a contact spring upper end support member. Also, as the pair of urging force application portions are provided on an end portion of each of a pair of inclined arm portions, through the pair of inclined arm portions extending diagonally downward and outward from two outer ends of the attachment plate portion in the longitudinal direction positioned on the upper side of the contact spring, the pair of urging force application portions has sufficient springiness, and it is thus possible to reliably and stably apply the predetermined urging force in a downward direction to the pair of movable contact portions.

BRIEF DESCRIPTION OF DRAWINGS

FIGS. 6(*a*) and 6(*b*) are sectional views, each showing the contact mechanism in the electromagnetic contactor shown in FIG. 5, wherein.

FIG. 6(*a*) is a sectional view when opened, while FIG. 6(*b*) is a sectional view when closed.

DESCRIPTION OF EMBODIMENTS

Figure 1:
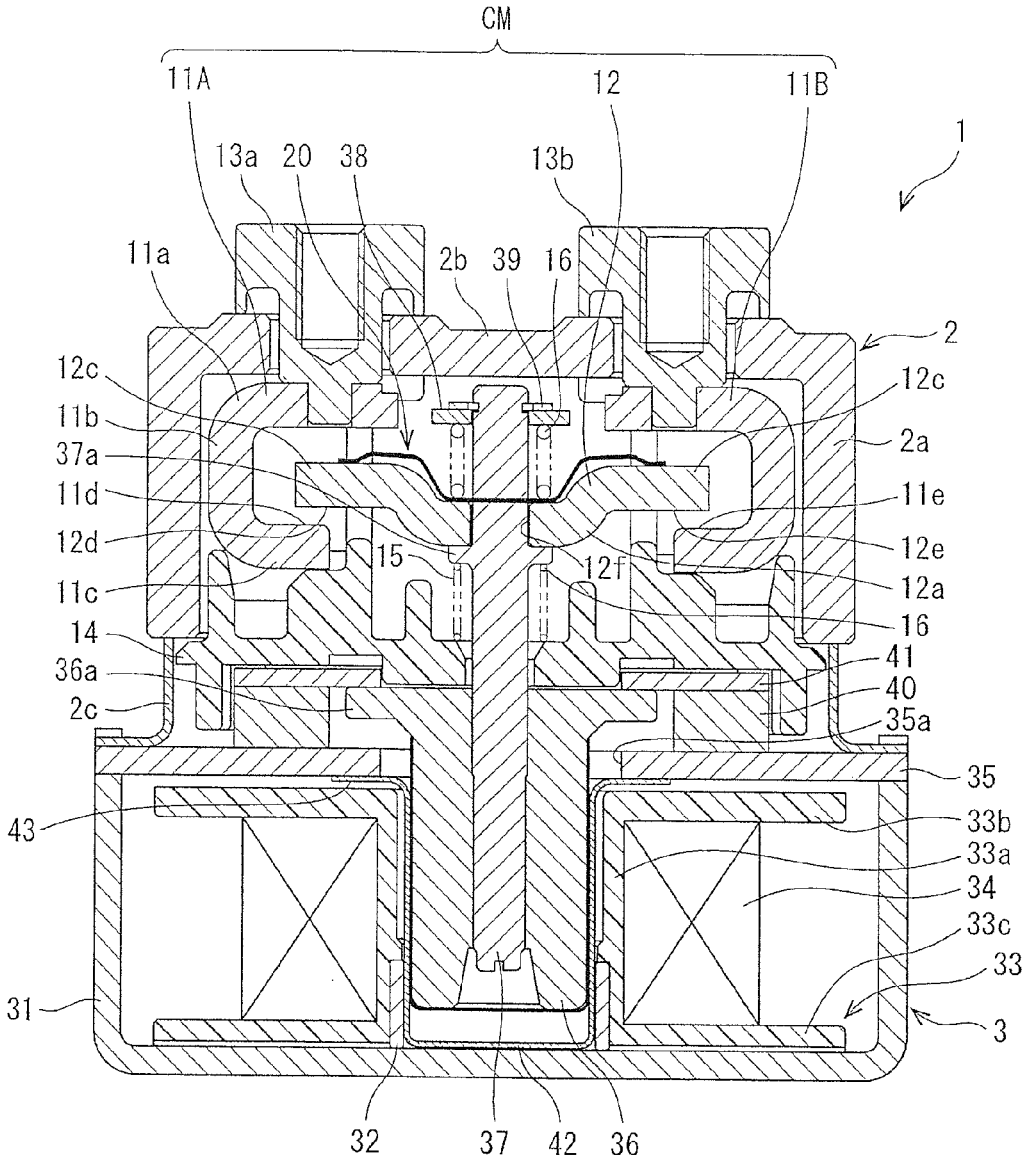
FIG. 1 is a sectional view of a first embodiment of an electromagnetic contactor according to the invention.
Figure 2:
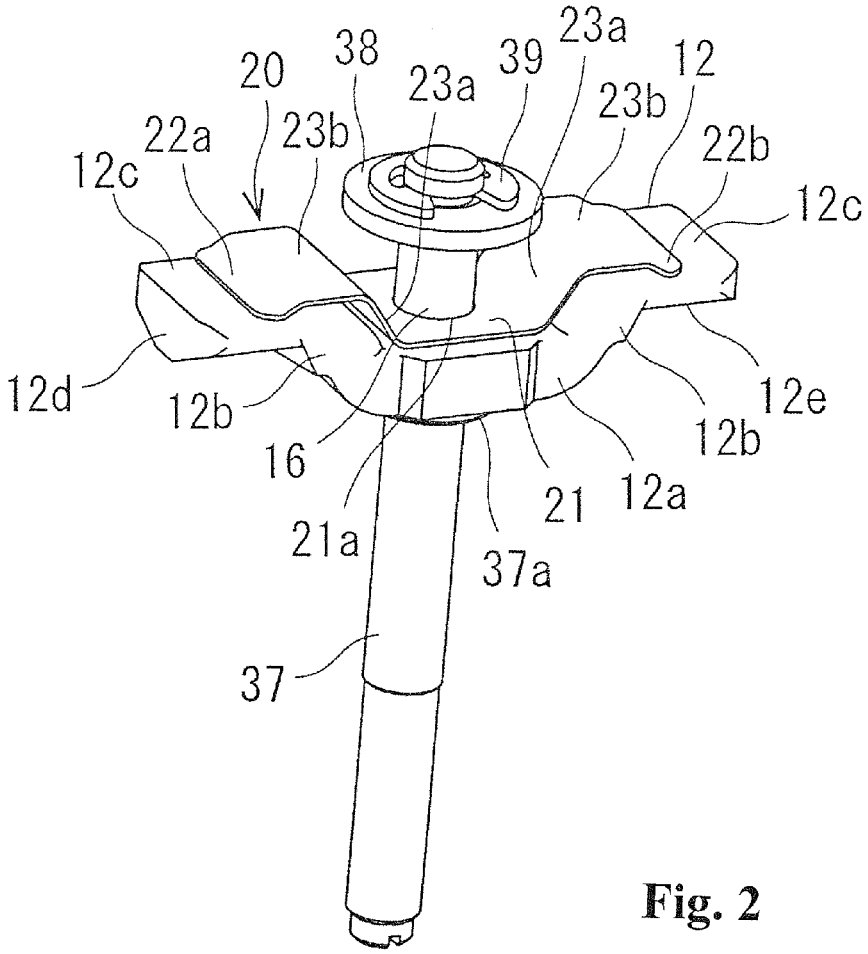
FIG. 2 is a perspective view showing the attachment structure of a connecting shaft, movable contact, and plate spring member in the electromagnetic contactor shown in FIG. 1.

Hereafter, a detailed description will be given, while referring to the drawings, of aspects (hereafter called embodiments) for implementing the invention. FIG. 1 is a sectional view of a first embodiment of an electromagnetic contactor according to the invention. FIG. 2 is a perspective view showing the attachment structure of a connecting shaft, movable contact, and plate spring member in the electromagnetic contactor shown in FIG. 1.

An electromagnetic contactor 1 shown in FIG. 1 includes an arc extinguishing chamber 2 that houses a contact mechanism CM, and an electromagnet unit 3 that drives the contact mechanism CM.

The arc extinguishing chamber 2 is integrally formed and includes a tubular portion 2*a*, formed of a ceramic or a synthetic resin material, and a top plate portion 2*b* that closes off the upper end of the tubular portion 2*a*. Further, a metalizing process is performed on the opened end surface side of the arc extinguishing chamber 2, thereby forming a metal foil, and a connecting member 2*c* made of metal is joined to the metal foil.

The contact mechanism CM, as shown in FIG. 1, includes a pair of fixed contacts 11A and 11B disposed to maintain a predetermined interval in a longitudinal direction (the left-right direction in FIG. 1), and a movable contact 12 connectable to and detachable from the pair of fixed contacts 11A and 11B.

The pair of fixed contacts 11A and 11B are fixed respectively to support conductor portions 13*a* and 13*b*, which are fixed to the top plate portion 2*b* of the arc extinguishing chamber 2. Further, each of the fixed contacts 11A and 11B is formed in a C-shape including an upper plate portion Ha extending parallel to the lower surface of the top plate portion 2*b*, an intermediate plate portion 11*b* extending downward from the outer side end portion of the upper plate portion 11*a*, and a lower plate portion 11*c* extending inward from a lower end portion of the intermediate plate portion 11*b*, parallel with the upper plate portion 11*a*. Further, the pair of fixed contacts 11A and 11B has respectively fixed contact portions 11*d* and 11*e* provided on the upper surface of the lower plate portion 11*c*.

Also, the movable contact 12 is formed of a plate-form body extending in a longitudinal direction, wherein the two end portions thereof in the longitudinal direction are disposed in the C-shapes of the fixed contacts 11A and 11B. The movable contact 12, as shown in FIG. 1 and FIG. 2, includes an attachment plate portion 12*a* positioned on a central portion thereof in a longitudinal direction, a pair of inclined portions 12*b* extending diagonally upward and outward from two outer ends of the attachment plate portion 12*a* in the longitudinal direction, and a pair of parallel portions 12*c* extending parallel to the attachment plate portion 12*a* from an end portion of each inclined portion 12*b* in the longitudinal direction. Further, a pair of movable contact portions 12*d* and 12*e*, which comes into contact with the fixed contact portions 11*d* and 11*e*, are respectively formed on the lower surfaces of the pair of parallel portions 12*c* in the vicinity of the end portion in the longitudinal direction. The movable contact 12 is held by a connecting shaft 37 fixed to a movable plunger 36 of the electromagnet unit 3, to be described hereafter, wherein a through hole 12*f* through which the connecting shaft 37 is inserted is formed in the attachment plate portion 12*a* to penetrate in a vertical direction. An outwardly protruding flange 37*a* is formed slightly above a vertical direction central portion of the connecting shaft 37. The movable contact 12 is disposed so as to be able to move in a vertical direction on the connecting shaft 37 fixed to the movable plunger 36, and is held on the connecting shaft 37 by pressed down with the biasing force of a contact spring 16 in the downward direction (to the fixed contact portions 11*d* and 11*e* side), which is formed of a compression spring, on the central portion of the movable contact 12 in the longitudinal direction. A method of holding the movable contact 12 will be described hereafter.

Also, a plate spring member 20 is attached to the connecting shaft 37. The plate spring member 20 is formed by punching and bending processes performed on a metal plate with springiness, extends in a longitudinal direction, and has, in the vicinities of two outer ends in the longitudinal direction, a pair of biasing force application portions 22*a* and 22*b* that applies a predetermined biasing force in a downward direction (to the fixed contact portions 11*d* and 11*e* side) to the pair of movable contact portions 12*d* and 12*e*. More specifically, the plate spring member 20, as shown in FIG. 2, includes a rectangular attachment plate portion 21 that has a through hole 21*a* penetrating vertically in the center thereof, a pair of inclined portions 23*a* extending diagonally upward and outward from the two outer ends of the attachment plate portion 21 in the longitudinal direction, a pair of horizontal portions 23*b* extending outward horizontally from an end portion of each inclined portion 23*a* in the longitudinal direction, and the pair of biasing force application portions 22*a* and 22*b*, standing downward from the outer end portion of each of the horizontal portions 23*b* in the longitudinal direction, that applies a predetermined biasing force in a downward direction to the pair of movable contact portions 12*d* and 12*e*. Further, the attachment plate portion 21 of the plate spring member 20 is disposed between the lower end of the contact spring 16 and the upper surface of the attachment plate portion 12*a* of the movable contact 12, and gripped between the lower end of the contact spring 16 and the upper surface of the attachment plate portion 12*a* of the movable contact 12 by the biasing force of the contact spring 16, thereby, the plate spring member 20 is attached to the connecting shaft 37.

Next, the method of attaching the movable contact 12, plate spring member 20, and contact spring 16 to the connecting shaft 37 will be described more specifically, referring to FIG. 1 and FIG. 2.

Firstly, the top end of the connecting shaft 37 is inserted through the through hole 12*f* of the movable contact 12, and the movable contact 12 is positioned on the flange 37*a* provided on the connecting shaft 37.

Next, the top end of the connecting shaft 37 is inserted through the through hole 21*a* of the plate spring member 20, and the plate spring member 20 is positioned on the movable contact 12. At this time, the attachment plate portion 21 of the plate spring member 20 is positioned on the attachment plate portion 12*a* of the movable contact 12, and the urging force application portions 22*a* and 22*b* are positioned on the parallel portions 12*c* of the movable contact 12.

Subsequently, the top end of the connecting shaft 37 is inserted through the contact spring 16, and the contact spring 16 is positioned on the attachment plate portion 21 of the plate spring member 20. Further, the top end of the connecting shaft 37 is inserted through a contact spring upper end support member 38 formed of a circular body, the contact spring upper end support member 38 is positioned on the contact spring 16, and the upper side of the contact spring upper end support member 38 is positioned by a C-ring 39 so as to obtain a predetermined urging force from the contact spring 16.

By so doing, the movable contact 12, plate spring member 20, and contact spring 16 are attached to the connecting shaft 37. Herein, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 22*a* and 22*b* in the vicinities of the two outer ends of the plate spring member 20 in the longitudinal direction, and thus held on the connecting shaft 37.

Further, when the movable contact 12 is in a released state wherein an electromagnetic coil 34 of the electromagnet unit 3, to be described hereafter, is in a non-excited state, the movable contact portions 12*d* and 12*e* are in a state separated by a predetermined interval from the fixed contact portions 11*d* and 11*e* of the pair of fixed contacts 11A and 11B.

Also, when the movable contact 12 is in an engaged state wherein the electromagnetic coil 34 is in an excited state, the movable contact portions 12*d* and 12*e* are in contact with the fixed contact portions 11*d* and 11*e* of the pair of fixed contacts 11A and 11B. At this time, the movable contact portions 12*d* and 12*e* are brought into contact with the fixed contact portions 11*d* and 11*e* by three urging forces, which are the predetermined urging force of the contact spring 16 on the central portion of the movable contact 12 in the longitudinal direction, and the predetermined urging force of the pair of urging force application portions 22*a* and 22*b* in the vicinities of the two outer ends of the plate spring member 20 in the longitudinal direction.

Next, the electromagnet unit 3, as shown in FIG. 1, has a magnetic yoke 31 of a flattened U-shape in the side view thereof, and a cylindrical auxiliary yoke 32 is fixed in a central portion of a bottom plate portion of the magnetic yoke 31. A spool 33 is disposed as a plunger drive portion on the outer side of the cylindrical auxiliary yoke 32.

The spool 33 includes a central cylinder portion 33*a* in which the cylindrical auxiliary yoke 32 is inserted, an upper flange portion 33*b* protruding outward in a radial direction from the upper end of the central cylinder portion 33*a*, and a lower flange portion 33*c* protruding outward in a radial direction from a lower end portion of the central cylinder portion 33*a*. Further, the electromagnetic coil 34 is mounted and wound in a housing space formed of the central cylinder portion 33*a*, upper flange portion 33*b*, and lower flange portion 33*c*.

Further, a plate-form upper magnetic yoke 35 is fixed between upper ends forming an opened end of the magnetic yoke 31. A through hole 35*a* opposing the central cylinder portion 33*a* of the spool 33 is formed in a central portion of the upper magnetic yoke 35.

Further, the movable plunger 36 is disposed in the central cylinder portion 33*a* of the spool 33 so as to be able to slide up and down. A peripheral flange portion 36*a* is formed on an upper end portion of the movable plunger 36 to protrude upward from the upper magnetic yoke 35 and to protrude outward in a radial direction.

Also, a permanent magnet 40 formed in a ring-form is fixed to the upper surface of the upper magnetic yoke 35 so as to enclose the peripheral flange portion 36*a* of the movable plunger 36. The permanent magnet 40 is magnetized such that, for example, the upper end side is an N-pole while the lower end side is an S-pole.

Further, an auxiliary yoke 41 having an external form same as the permanent magnet 40, and having a through hole with an inner diameter smaller than the outer diameter of the peripheral flange portion 36*a* of the movable plunger 36, is fixed to the upper end surface of the permanent magnet 40. The peripheral flange portion 36*a* of the movable plunger 36 is opposed by the lower surface of the auxiliary yoke 41. Consequently, movement in an upward direction of the movable plunger 36 is regulated by the peripheral flange portion 36*a* coming into contact with the lower surface of the auxiliary yoke 41, while movement in a downward direction of the movable plunger 36 is regulated by the peripheral flange portion 36*a* coming into contact with the upper surface of the upper magnetic yoke 35.

Also, the connecting shaft 37, which supports the movable contact 12 on the upper side, is formed so as to protrude upward in the movable plunger 36. Further, an insulating body 14, which is the upper surface of the auxiliary yoke 41, is installed between the pair of fixed contacts 11A and 11B. Further, a return spring formed of a compression spring is supported between the insulating body 14 and the flange 37*a* of the connecting shaft 37. The return spring 15 constantly biases the connecting shaft 37 upward with a predetermined urging force.

At least the lower end portion side of the movable plunger 36 is covered with a cap 42, formed in a bottomed tubular form, made of a non-magnetic body and opened upward. The bottom portion side of the cap 42 is inserted so as to fit inside the central cylinder portion 33*a* of the spool 33. By so doing, the bottom end portion side of the movable plunger 36 attains a state wherein it is in proximity to the interior of the central cylinder portion 33*a* of the spool 33 through the cap 42.

Further, a flange 43 formed to extend outward in a radial direction is provided on the opened end side of the cap 42. The flange 43 is seal-joined to the lower surface of the upper magnetic yoke 35. By so doing, a hermetic receptacle (sealed structure), wherein the arc extinguishing chamber 2 and cap 42 are in communication via the through hole 35*a* of the upper magnetic yoke 35, is formed. Further, a gas such as hydrogen gas, nitrogen gas, a mixed gas of hydrogen and nitrogen, air, or $SF_6$ is encapsulated inside the hermetic receptacle formed by the arc extinguishing chamber 2 and cap 42. Because of this, the movable plunger 36 is positioned inside the hermetic receptacle.

A description has been given of a case in which a hermetic receptacle is formed of the arc extinguishing chamber 2 and cap 42, and gas is encapsulated inside the hermetic receptacle, but the invention, of course, is not limited to this, and the gas encapsulation may be omitted. For example, this is the case where the interrupted current is small.

Next, a description will be given of the electromagnetic contactor 1 formed in this way.

It is assumed that the fixed contact 11A is connected to, for example, a power supply source that supplies a large current, while the fixed contact 11B is connected to a load.

In this state, when the electromagnetic coil 34 in the electromagnet unit 3 is in a non-excited state, and is in a released state, no exciting force causing the movable plunger 36 to descend is generated in the electromagnet unit 3, and the movable plunger 36 is urged in an upward direction away from the upper magnetic yoke 35 by the urging force of the return spring 15 via the connecting shaft 37. Simultaneously with this, a suctioning force created by the magnetic force of the permanent magnet 40 acts on the auxiliary yoke 41, and the upper surface of the peripheral flange portion 36*a* of the movable plunger 36 is brought into contact with the lower surface of the auxiliary yoke 41.

Because of this, the movable contact portions 12*d* and 12*e* of the movable contact 12 supported by the connecting shaft 37 fixed to the movable plunger 36 are in a state separated by a predetermined interval upward from the fixed contact portions 11*d* and 11*e* of the pair of fixed contacts 11A and 11B. The state wherein the upper surface of the peripheral flange portion 36*a* of the movable plunger 36 is in contact with the lower surface of the auxiliary yoke 41 is the final state of release.

In this final state of release, the current between the pair of fixed contacts 11A and 11B is in an interrupted state, and the contact mechanism CM is in an open state. When the contact mechanism CM is in an open state, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 22*a* and 22*b* in the vicinities of the two outer ends of the plate spring member 20 in the longitudinal direction, and thus held on the connecting shaft 37.

On the electromagnetic coil 34 of the electromagnet unit 3 excited when the contact mechanism CM is in an open state, to create an engaged state, an exciting force is generated in the electromagnet unit 3, and the movable plunger 36 is pressed downward against the urging force of the return spring 15 and the suctioning force of the permanent magnet 40.

By descending the movable plunger 36, the movable contact 12 supported by the connecting shaft 37 fixed to the movable plunger 36 also descends, and the movable contact portions 12*d* and 12*e* contact the fixed contact portions 11*d* and 11*e* of the pair of fixed contacts 11A and 11B. At this time, the movable contact portions 12*d* and 12*e* are brought into contact with the fixed contact portions 11*d* and 11*e* by three urging forces, which are the predetermined urging force of the contact spring 16 on the central portion of the movable contact 12 in the longitudinal direction, and the predetermined urging force of the pair of urging force application portions 22*a* and 22*b* in the vicinities of the two outer ends of the plate spring member 20 in the longitudinal direction.

Because of this, the contact mechanism CM is in a closed state wherein the large current of the external power supply source is supplied via the fixed contact 11A, movable contact 12, and fixed contact 11B to the load.

Herein, as the movable contact portions 12*d* and 12*e* are brought into contact with the fixed contact portions 11*d* and 11*e* by three urging forces, which are the predetermined urging force of the contact spring 16 on the central portion of the movable contact 12 in the longitudinal direction, and the predetermined urging force of the pair of urging force application portions 22*a* and 22*b* in the vicinities of the two outer ends of the plate spring member 20 in the longitudinal direction; the movable contact 12 does not wobble in the longitudinal direction, even when the flatness of the contact spring 16 is inappropriate, or there is deviation in the direction that the contact spring 16 is attached. Because of this, when the contact mechanism CM is in a closed state, emission of a whirring sound and erosion of the movable contact 12 and the pair of fixed contacts 11A and 11B by the arc are suppressed.

Further, when the excited state of the electromagnetic coil 34 in the electromagnet unit 3 continues, the movable contact 12 descends from the movable contact portions 12*d* and 12*e* in contact with the fixed contact portions 11*d* and 11*e* of the pair of fixed contacts 11A and 11B until the peripheral flange portion 36*a* of the movable plunger 36 contacts the upper surface of the upper magnetic yoke 35. At this time, the contact pressure of the movable contact portions 12*d* and 12*e* against the fixed contact portions 11*d* and 11*e* increases by the amount of the urging force of the contact spring 16 compared with when the movable contact portions 12*d* and 12*e* originally contact the fixed contact portions 11*d* and 11*e*.

Further, when the contact mechanism CM is in an open state, the electromagnet unit 3 is in a non-excited state; and the movable plunger 36 moves upward due to the urging force of the return spring 15, and a final state of release is created. In the final state of release, the movable contact portions 12*d* and 12*e* of the movable contact 12 supported by the connecting shaft 37 fixed to the movable plunger 36 are separated by a predetermined interval upward from the fixed contact portions 11*d* and 11*e* of the pair of fixed contacts 11A and 11B.

When the contact mechanism CM is in an open state, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 22*a* and 22*b* in the vicinities of the two outer ends of the plate spring member 20 in the longitudinal direction, and thus held on the connecting shaft 37. Because of this, when the movable contact 12 is in the final state of release, the movable contact 12 does not wobble in the longitudinal direction. Because of this, the contact gap is uniform in the longitudinal direction of the movable contact 12, and stable interruption is achieved.

As the pair of biasing force application portions 22*a* and 22*b* stand downward from the outer end portion of each of the pair of horizontal portions 23*b* in the longitudinal direction through the pair of inclined portions 23*a* extending diagonally upward and outward from the two outer ends of the attachment plate portion 21 in the longitudinal direction and the pair of horizontal portions 23*b* extending outward horizontally in a longitudinal direction from an end portion of each of the pair of inclined portions 23*a*, and applies a predetermined biasing force in a downward direction to the pair of movable contact portions 12*d* and 12*e*; the pair of biasing force application portions 22*a* and 22*b* have sufficient springiness, and it is thus possible to reliably apply the predetermined biasing force in a downward direction to the pair of movable contact portions 12*d* and 12*e*.

Figure 3:
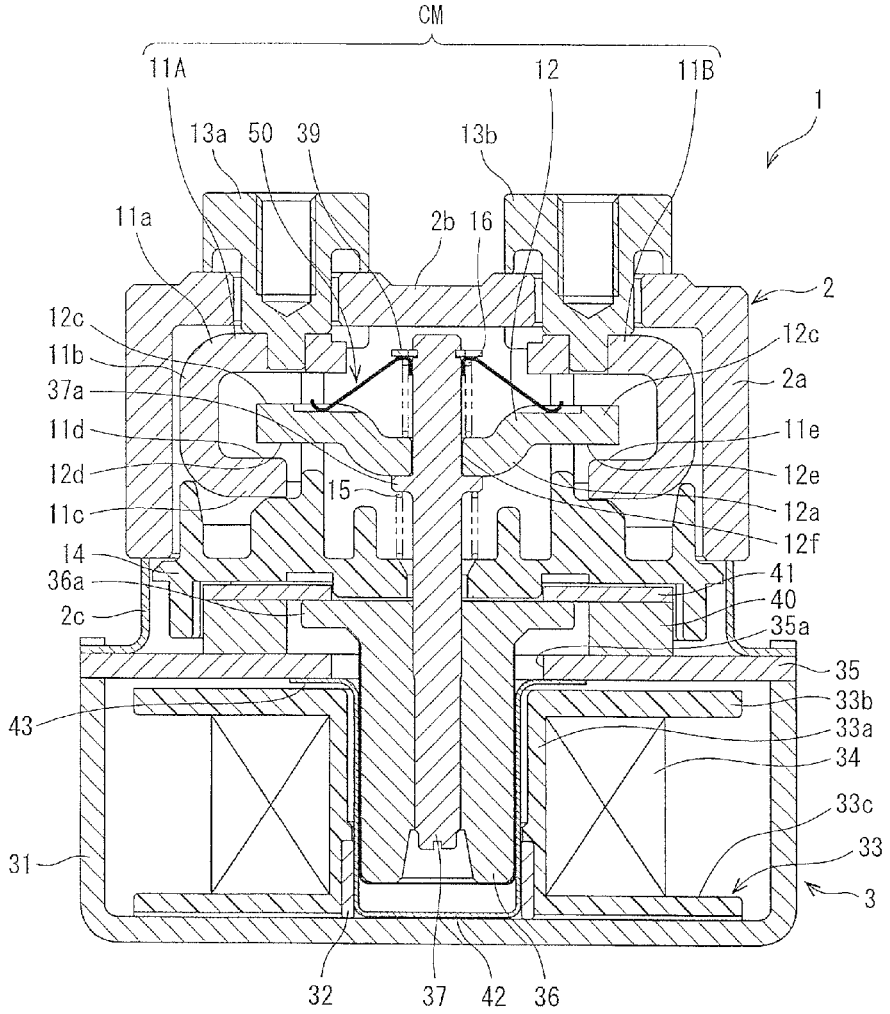
FIG. 3 is a sectional view of a second embodiment of the electromagnetic contactor according to the invention.
Figure 4:
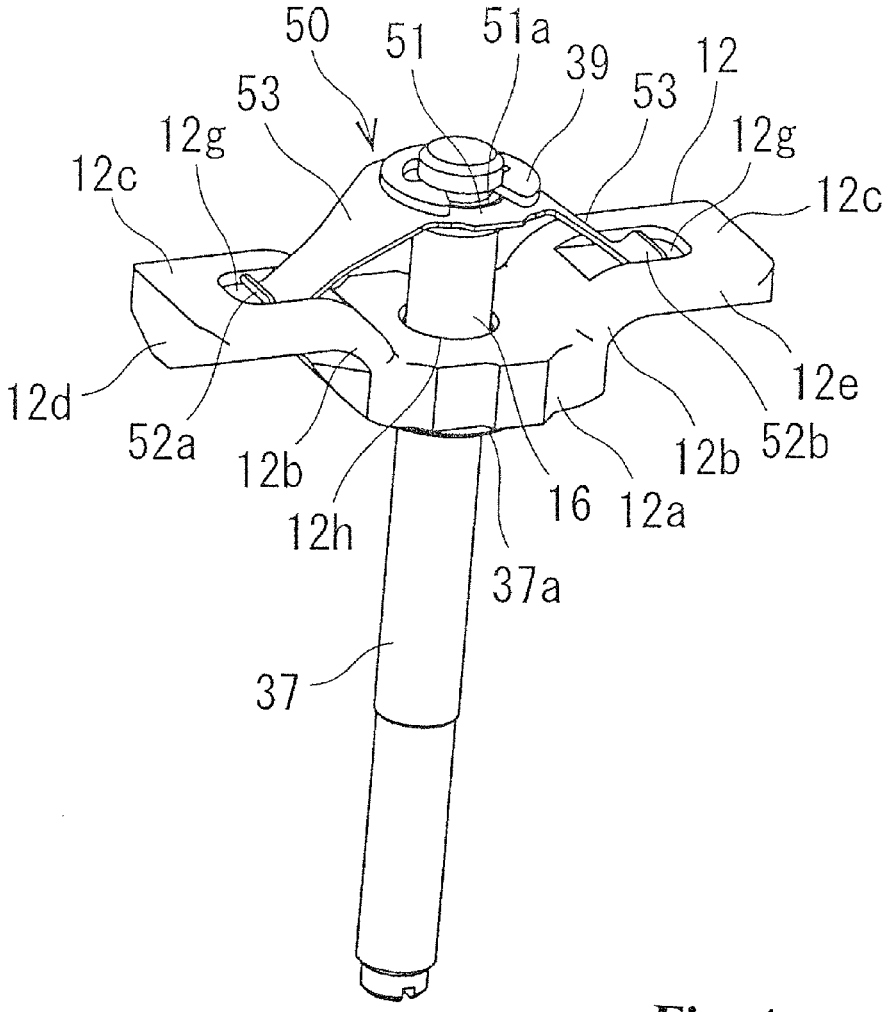
FIG. 4 is a perspective view showing the attachment structure of a connecting shaft, movable contact, and plate spring member in the electromagnetic contactor shown in FIG. 3.
Figure 5:
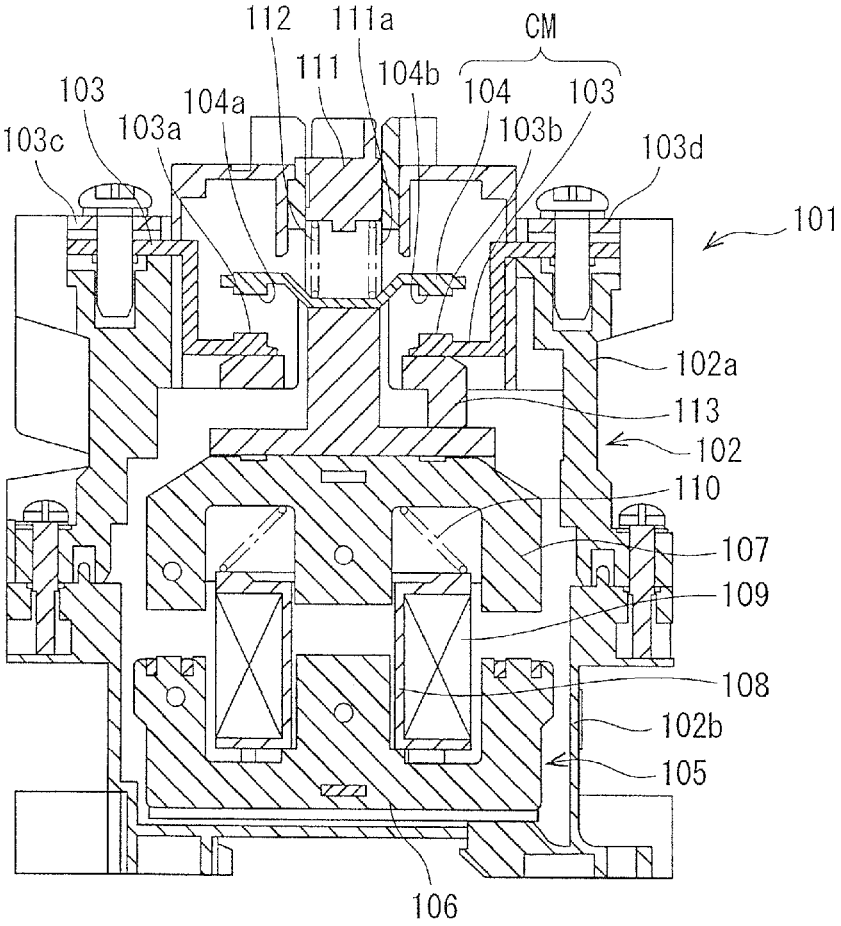
Fig. 5 Prior Art
FIG. 5 is a sectional view showing an existing electromagnetic contactor having a contact mechanism that includes a pair of fixed contacts disposed to maintain a predetermined interval in a longitudinal direction and a movable contact that is connectable to and detachable from the fixed contacts.
Figure 6A:
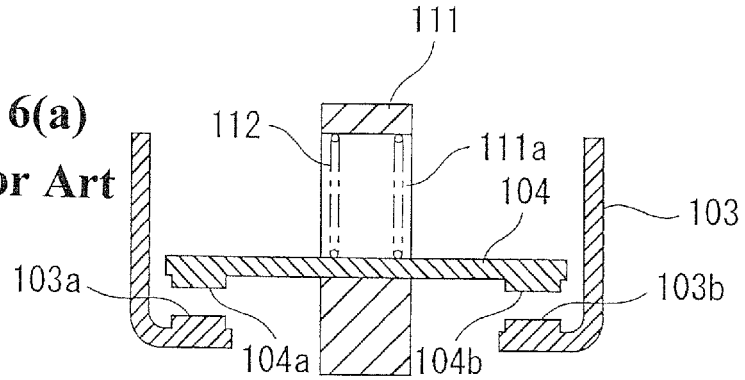
Fig. 6(a) Prior Art
Figure 6B:
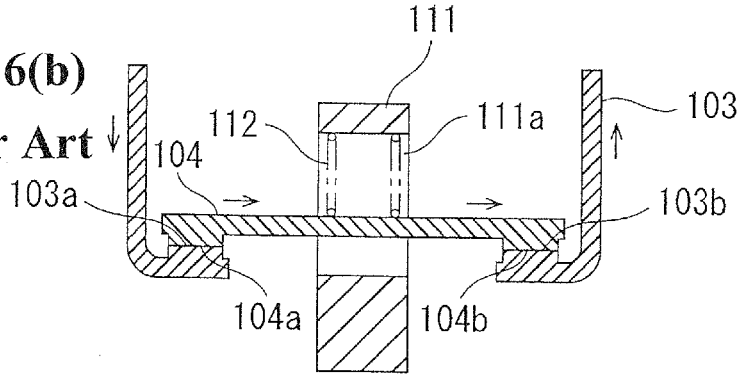
Fig. 6(b) Prior Art

Next, a description will be given, referring to FIG. 3 and FIG. 4, of a second embodiment of the electromagnetic contactor according to the invention. FIG. 3 is a sectional view of the second embodiment of the electromagnetic contactor according to the invention. FIG. 4 is a perspective view showing the attachment structure of a connecting shaft, movable contact, and plate spring member in the electromagnetic contactor shown in FIG. 3. In FIG. 3 and FIG. 4, the same reference signs are given to members same as the members shown in FIG. 1 and FIG. 2, and a description thereof may be omitted.

The electromagnetic contactor 1 shown in FIG. 3 is the same basic structure as the electromagnetic contactor 1 shown in FIG. 1 and FIG. 2, but the configuration, form, and attachment method of a plate spring member 50 are differ from the configuration, form, and attachment method of the plate spring member 20 shown in FIG. 1 and FIG. 2.

That is, the plate spring member 50, as shown in FIG. 4, includes a rectangular attachment plate portion 51 that has a through hole 51*a* penetrating vertically in the center thereof, a pair of inclined arm portions 53 extending diagonally downward and outward from the two outer ends of the attachment plate portion 51 in the longitudinal direction, and a pair of urging force application portions 52*a* and 52*b*, provided on an end portion of each of the pair of inclined arm portions 53, that applies a predetermined urging force in a downward direction to the pair of movable contact portions 12*d* and 12*e*. The plate spring member 50 is formed by punching and bending processes performed on a metal plate with springiness. Further, the attachment plate portion 51 of the plate spring member 50 is disposed between the upper end of the contact spring 16 and a C-ring 51*a* attached to the connecting shaft 37, and gripped between the upper end of the contact spring 16 and the C-ring 39 by the urging force of the contact spring 16, because of which the plate spring member 50 is held to the connecting shaft 37.

Also, a depressed portion 12*g* that receives one of the urging force application portions 52*a* and 52*b* of the plate spring member 50 is formed in the upper surface of each parallel portion 12*c* of the movable contact 12.

When using the plate spring member 50, the attachment plate portion 51 of the plate spring member 50 also functions as a contact spring upper end support member that supports the upper end of the contact spring 16, and it is thus possible to eliminate the need to separately provide a contact spring upper end support member, as the case with the electromagnetic contactor 1 shown in FIG. 1 and FIG. 2.

Next, referring to FIG. 3 and FIG. 4, a specific description will be given of a method of attaching the movable contact 12, contact spring 16, and plate spring member 50 to the connecting shaft 37.

Firstly, the top end of the connecting shaft 37 is inserted through the through hole 12*f* of the movable contact 12, and the movable contact 12 is positioned on the flange 37*a* provided on the connecting shaft 37.

Next, the top end of the connecting shaft 37 is inserted through the contact spring 16, and the contact spring 16 is positioned on the depressed portions 12 formed in the upper surface of the movable contact 12.

Further, the top end of the connecting shaft 37 is inserted through the through hole 51*a* formed in the attachment plate portion 51 of the plate spring member 50, and the plate spring member 50 is positioned on the contact spring 16.

Subsequently, the upper side of the attachment plate portion 51 of the plate spring member 50 is positioned by the C-ring 39 so as to obtain a predetermined urging force from the contact spring 16.

By so doing, the movable contact 12, contact spring 16, and plate spring member 50 are attached to the connecting shaft 37. Herein, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 52*a* and 52*b* in the vicinities of the two outer ends of the plate spring member 50 in the longitudinal direction, and thus held on the connecting shaft 37.

Next, an operation of the electromagnetic contactor 1 shown in FIG. 3 will be described. Firstly, when the electromagnetic coil 34 in the electromagnet unit 3 is in a non-excited state, and it is in a released state, no exciting force causing the movable plunger 36 to descend is generated in the electromagnet unit 3, and the movable plunger 36 is urged in an upward direction away from the upper magnetic yoke 35 by the urging force of the return spring 15 via the connecting shaft 37. Simultaneously with this, a suctioning force created by the magnetic force of the permanent magnet 40 acts on the auxiliary yoke 41, and the upper surface of the peripheral flange portion 36*a* of the movable plunger 36 is brought into contact with the lower surface of the auxiliary yoke 41.

Because of this, the movable contact portions 12*d* and 12*e* of the movable contact 12 supported by the connecting shaft 37 fixed to the movable plunger 36 are in a state separated by a predetermined interval upward from the fixed contact portions 11*d* and 11*e* of the pair of fixed contacts 11A and 11B. The state wherein the upper surface of the peripheral flange portion 36*a* of the movable plunger 36 is in contact with the lower surface of the auxiliary yoke 41, is the final state of release.

In this final state of release, the current between the pair of fixed contacts 11A and 11B is in an interrupted state, and the contact mechanism CM is in an open state. When the contact mechanism CM is in an open state, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 52*a* and 52*b* in the vicinities of two outer ends of the plate spring member 50 in the longitudinal direction, and thus held on the connecting shaft 37.

On the electromagnetic coil 34 of the electromagnet unit 3 excited when the contact mechanism CM is in an open state, to create an engaged state, an exciting force is generated in the electromagnet unit 3, and the movable plunger 36 is pressed downward against the urging force of the return spring 15 and the suctioning force of the permanent magnet 40.

By descending the movable plunger 36, the movable contact 12 supported by the connecting shaft 37 fixed to the movable plunger 36 also descends, and the movable contact portions 12*d* and 12*e* contact the fixed contact portions 11*d* and 11*e* of the pair of fixed contacts 11A and 11B. At this time, the movable contact portions 12*d* and 12*e* are brought into contact with the fixed contact portions 11*d* and 11*e* by three urging forces, which are the predetermined urging force of the contact spring 16 on the central portion of the movable contact 12 in the longitudinal direction, and the predetermined urging force of the pair of urging force application portions 52*a* and 52*b* in the vicinities of the two outer ends of the plate spring member 50 in the longitudinal direction.

Because of this, the contact mechanism CM is in a closed state wherein the large current of the external power supply source is supplied via the fixed contact 11A, movable contact 12, and fixed contact 11B to the load.

Herein, as the movable contact portions 12*d* and 12*e* are brought into contact with the fixed contact portions 11*d* and 11*e* by three urging forces, which are the predetermined urging force of the contact spring 16 on the central portion of the movable contact 12 in the longitudinal direction, and the predetermined urging force of the pair of urging force application portions 52*a* and 52*b* in the vicinities of the two outer ends of the plate spring member 50 in the longitudinal direction; the movable contact 12 does not wobble in the longitudinal direction, even when the flatness of the contact spring 16 is inappropriate, or there is deviation in the direction that the contact spring 16 is attached. Because of this, when the contact mechanism CM is in a closed state, emission of a whirring sound and erosion of the movable contact 12 and the pair of fixed contacts 11A and 11B by the arc are suppressed.

Further, when the excited state of the electromagnetic coil 34 in the electromagnet unit 3 continues, the movable contact 12 descends from the movable contact portions 12*d* and 12*e* in contact with the fixed contact portions 11*d* and 11*e* of the pair of fixed contacts 11A and 11B until the peripheral flange portion 36*a* of the movable plunger 36 comes into contact with the upper surface of the upper magnetic yoke 35. At this time, the contact pressure of the movable contact portions 12*d* and 12*e* against the fixed contacts 11*d* and 11*e* increases by amount of the biasing force of the contact spring 16 as compared with when the movable contact portions 12*d* and 12*e* originally come into contact with the fixed contact portions 11*d* and 11*e*.

Further, when the contact mechanism CM is in an opened state, the electromagnet unit 3 is in a non-excited state; and the movable plunger 36 moves upward due to the biasing force of the return spring 15, and a released state is created. In the released state, the movable contact portions 12*d* and 12*e* of the movable contact 12 supported by the connecting shaft 37 fixed to the movable plunger 36 are in a state separated by a predetermined interval upward from the fixed contact portions 11*d* and 11*e* of the pair of fixed contacts 11A and 11B.

When the contact mechanism CM is in an open state, the movable contact 12 is pressed down against the flange 37*a* by the urging force of the contact spring 16 in the downward direction on the central portion in the longitudinal direction, and by the urging force in the downward direction on the pair of movable contact portions 12*d* and 12*e* of the pair of urging force application portions 52*a* and 52*b* in the vicinities of the two outer ends of the plate spring member 50 in the longitudinal direction, and thus held on the connecting shaft 37, because of which, when the movable contact 12 is in the final state of release, the movable contact 12 does not wobble in the longitudinal direction. Because of this, the contact gap is uniform in the longitudinal direction of the movable contact 12, and stable interruption is achieved.

As the pair of urging force application portions 52*a* and 52*b* are provided on an end portion of each of the pair of inclined arm portions 53, through the pair of inclined arm portions 53 extending diagonally downward and outward from the two outer ends of the attachment plate portion 51 positioned on the upper side of the contact spring 16, the pair of urging force application portions 52*a* and 52*b* have sufficient springiness, and it is thus possible to reliably and stably apply the predetermined urging force in a downward direction to the pair of movable contact portions 12*d* and 12*e*.

Heretofore, a description has been given of embodiments of the invention, but the invention is not limited by this, and various changes and improvements can be carried out.

For example, if the plate spring member extends in a longitudinal direction, has, in the vicinities of the two outer end in the longitudinal direction, a pair of urging force application portions that applies a predetermined urging force in a downward direction to the pair of movable contact portions 12*d* and 12*e*, and is attached to the connecting shaft 37, the plate spring member is not limited to the form of the plate spring member 20 shown in FIG. 1 and FIG. 2 or the plate spring member 50 shown in FIG. 3 and FIG. 4.

REFERENCE SIGNS LIST

1 Electromagnetic contactor
2 Arc extinguishing chamber
2*a* Tubular portion
2*b* Top plate portion
2*c* Connecting member
3 Electromagnet unit
11A, 11B Fixed contact
11*a* Upper plate portion
11*b* Intermediate plate portion
11*c* Lower plate portion
11*d*, 11*e* Fixed contact
12 Movable contact
12*a* Attachment plate portion
12*b* Inclined portion
12*c* Parallel portion
12*d*, 12*e* Movable contact
12*f* Through hole
12*g* Depressed portion
12*h* Depressed portion
13*a*, 13*b* Support conductor portion
14 Insulating body
15 Return spring
16 Contact spring
20 Plate spring member
21 Attachment plate portion
21*a* Through hole
22*a*, 22*b* Biasing force application portion
23*a* Inclined portion
23*b* Horizontal portion
31 Magnetic yoke
32 Cylindrical auxiliary yoke
33 Spool
33*a* Central cylinder portion
33*b* Upper flange portion
33*c* Lower flange portion
34 Electromagnetic coil
35 Upper magnetic yoke
35*a* Through hole
36 Movable plunger
36*a* Peripheral flange portion
37 Connecting shaft
37*a* Flange
38 Contact spring upper end support member
39 C-ring
40 Permanent magnet
41 Auxiliary yoke
42 Cap
43 Flange
50 Plate spring member
51 Attachment plate portion
51*a* Through hole
52*a*, 52*b* Biasing force application portion
53 Inclined arm portion
CM Contact mechanism

What is claimed is:

1. An electromagnetic contactor, comprising:

a contact mechanism having a pair of fixed contacts disposed to maintain a predetermined interval in a longitudinal direction thereof; and a movable contact disposed above the pair of fixed contacts, the movable contact contacting to and detaching from the pair of fixed contacts, wherein each of the pair of fixed contacts has a fixed contact portion, the movable contact extends in a longitudinal direction thereof and has a pair of movable contact portions contacting the pair of fixed contacts, and the movable contact is disposed so as to move in a vertical direction thereof on a connecting shaft fixed to a movable plunger and is pressed down by an urging force of a contact spring in a downward direction thereof on a central portion of the movable contact in the longitudinal direction thereof, the movable contact being held on the connecting shaft, a plate spring member, extending in a longitudinal direction thereof and having, in vicinities of two outer ends in the longitudinal direction of the plate spring member, a pair of urging force application portions that applies a predetermined urging force in the downward direction to the pair of movable contact portions, is attached to the connecting shaft, and the plate spring member includes an attachment plate portion arranged between the contact spring and the movable contact so that the movable contact is urged by the urging force of the contact spring and the plate spring member.

2. The electromagnetic contactor according to claim 1, wherein the contact spring is fixed between an upper end of the connecting shaft and the plate spring member so that the contact spring applies the urging force to the central portion of the movable contact and the pair of urging force application portions applies urging force to two outer ends of the movable contact.

3. An electromagnetic contactor, comprising:

a contact mechanism having a pair of fixed contacts disposed to maintain a predetermined interval in a longitudinal direction thereof; and a movable contact disposed above the pair of fixed contacts, the movable contact contacting to and detaching from the pair of fixed contacts, wherein each of the pair of fixed contacts has a fixed contact portion, the movable contact extends in a longitudinal direction thereof and has a pair of movable contact portions contacting the pair of fixed contacts, and the movable contact is disposed so as to move in a vertical direction thereof on a connecting shaft fixed to a movable plunger and is pressed down by an urging force of a contact spring in a downward direction thereof on a central portion of the movable contact in the longitudinal direction thereof, the movable contact being held on the connecting shaft, a plate spring member, extending in a longitudinal direction thereof and having, in vicinities of two outer ends in the longitudinal direction of the plate spring member, a pair of urging force application portions that applies a predetermined urging force in the downward direction to the pair of movable contact portions, is attached to the connecting shaft, and the plate spring member includes an attachment plate portion disposed between a lower end of the contact spring and an upper surface of the movable contact and gripped between the lower end of the contact spring and the upper surface of the movable contact by the urging force of the contact spring, a pair of inclined portions extending diagonally upward and outward from two outer ends of the attachment plate portion in a longitudinal direction thereof, a pair of horizontal portions extending outward horizontally in the longitudinal direction of the attachment plate portion from an end portion of each of the pair of inclined portions, and the pair of urging force application portions, standing downward from an outer end portion of each of the pair of horizontal portions in the longitudinal direction of the attachment plate portion, and applying a predetermined urging force in the downward direction to the pair of movable contact portions.

4. An electromagnetic contactor, comprising:

a contact mechanism having a pair of fixed contacts disposed to maintain a predetermined interval in a longitudinal direction thereof; and a movable contact disposed above the pair of fixed contacts, the movable contact contacting to and detaching from the pair of fixed contacts, wherein each of the pair of fixed contacts has a fixed contact portion, the movable contact extends in a longitudinal direction thereof and has a pair of movable contact portions contacting the pair of fixed contacts, and the movable contact is disposed so as to move in a vertical direction thereof on a connecting shaft fixed to a movable plunger and is pressed down by an urging force of a contact spring in a downward direction thereof on a central portion of the movable contact in the longitudinal direction thereof, the movable contact being held on the connecting shaft, a plate spring member, extending in a longitudinal direction thereof and having, in vicinities of two outer ends in the longitudinal direction of the plate spring member, a pair of urging force application portions that applies a predetermined urging force in the downward direction to the pair of movable contact portions, is attached to the connecting shaft, and the plate spring member includes an attachment plate portion disposed between an upper end of the contact spring and a C-ring attached to the connecting shaft and gripped between the upper end of the contact spring and the C-ring by the urging force of the contact spring, a pair of inclined arm portions extending diagonally downward and outward from two outer ends of the attachment plate portion in a longitudinal direction thereof, and the pair of urging force application portions, provided on an end portion of each of the pair of inclined arm portions, and applying the predetermined urging force in the downward direction to the pair of movable contact portions.

* * * * *